United States Patent [19]

Lenhart

[11] Patent Number: 4,577,867

[45] Date of Patent: Mar. 25, 1986

[54] SHORT FLIGHT GOLF BALL AND GAME

[75] Inventor: John W. Lenhart, Hilton, N.Y.

[73] Assignee: Lenkin Ltd., Rochester, N.Y.

[21] Appl. No.: 550,179

[22] Filed: Nov. 9, 1983

[51] Int. Cl.[4] ..... A63B 67/02; A63B 37/14

[52] U.S. Cl. ..... 273/176 AB; 273/58 R; 272/232

[58] Field of Search ..... 273/176 R, 176 A, 176 AA, 273/176 AB, 176 D, 176 G, 62, 232, 233, 58 D, 58 K, 58 R

[56] References Cited

U.S. PATENT DOCUMENTS

| | | | |
|---|---|---|---|
| 1,981,959 | 11/1934 | Landreth . | |
| 2,882,058 | 4/1959 | Brandon . | |
| 3,147,979 | 9/1964 | Wolfe . | |
| 3,198,526 | 8/1965 | Smith et al. . | |
| 3,288,469 | 11/1966 | Shaw . | |
| 3,427,030 | 2/1969 | Ward | 273/176 AB |
| 3,458,206 | 7/1969 | Kane et al. . | |
| 3,627,326 | 12/1971 | Berry . | |
| 3,697,081 | 10/1972 | Peyroux . | |
| 3,940,145 | 2/1976 | Gentiluomo . | |
| 3,999,764 | 12/1976 | Nitsche | 273/176 AB |
| 4,006,908 | 2/1977 | Minami . | |
| 4,150,826 | 4/1979 | Baldorossi et al. . | |
| 4,208,053 | 6/1980 | Farr . | |

FOREIGN PATENT DOCUMENTS

| | | | |
|---|---|---|---|
| 161075 | 4/1933 | Switzerland | 273/176 D |

*Primary Examiner*—William H. Grieb

*Attorney, Agent, or Firm*—Stonebraker, Shepard & Stephens

[57] ABSTRACT

Short flight golf is played with a ball 10 having a spherical foam body 11 approximately the size of a regulation golf ball for hitting with regulation golf clubs. Foam body 11 is formed of reticulated resinous veins 12 and includes a central core 15 that is smaller and lighter than a regulation golf ball. Reticulated veins 12 are severed at the spherical exterior 14 of foam body 11 and have a sufficient void volume in the region between core 15 and severed exterior 14 so that air moves through the voids 13 between veins 12 as ball 10 flies through air. This air movement relative to reticulated veins 12 produces sufficient aerodynamic drag to limit the flight of ball 10 to preferably 60 to 70 feet. A short flight golf course for play with short flight ball 10 preferably includes several fairways approaching a single green 20 from different directions and distances over which short flight ball 10 is played to a lie on green 20 whereupon a regulation ball is substituted for putting.

17 Claims, 4 Drawing Figures

SHORT FLIGHT GOLF BALL AND GAME

BACKGROUND

I have devised a short flight golf ball and game that preserves the challenge and interest of regulation golf while greatly reducing the space required. Regulation golf clubs can play my short flight ball over a compact course that can fit in a backyard.

Although my golf ball flies only a short distance, it preserves the feel and sound of hitting a regulation golf ball. My ball also will not hurt people or break windows. My combination of a realistically playable short flight ball and a more compact layout for short flight golf courses allows the game of golf to be enjoyed at home.

SUMMARY OF THE INVENTION

My short flight golf ball has a spherical foam body approximately the size of a regulation golf ball for hitting with regulation clubs. Its body is formed with reticulated resinous veins, and it has a central core substantially smaller and lighter than a regulation golf ball. The reticulated veins are severed at the spherical exterior of the foam body; and between the core and the severed exterior, the reticulated veins have a substantial void volume. Air moves through voids between the veins as the ball flies through air, and the air movement relative to the reticulated veins produces sufficient aerodynamic drag to shorten the ball's flight to about one-sixth the flight of a regulation golf ball.

My short flight golf game uses a green with a cup and a flag and a plurality of tees and fairways arranged for approaching the green from different directions and distances. Golfers play my short flight golf ball sequentially from the tees to the green where they substitute a regulation golf ball for putting.

DRAWINGS

DETAILED DESCRIPTION

My short flight golf ball 10 includes a weighted core 15 that gives a golfer the feel of hitting a regulation golf ball. A body 11 surrounds core 15 and provides aerodynamic drag to limit the ball's flight to preferably about 60 to 70 feet. Ball 10 can be hit with regulation golf clubs without risk to windows, people, or animals. Its short flight enables small-scale golf courses as explained after the following description of ball 10.

Figure 1:
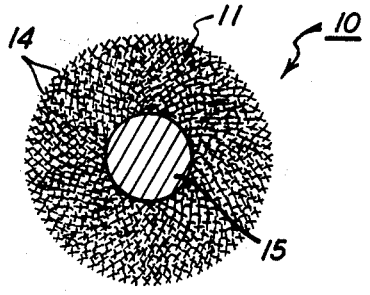
FIG. 1 is a partially schematic plan view of my short flight golf ball.
Figure 2:
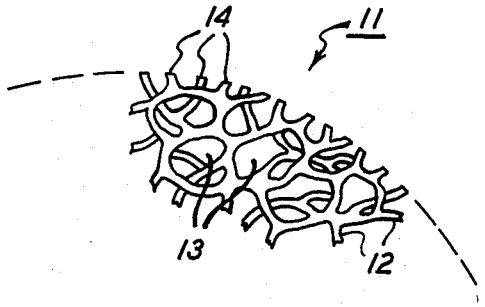
FIG. 2 is an enlarged view of a fragment of the reticulated vein network near the severed external surface of the ball of FIG. 1.
Figure 3:
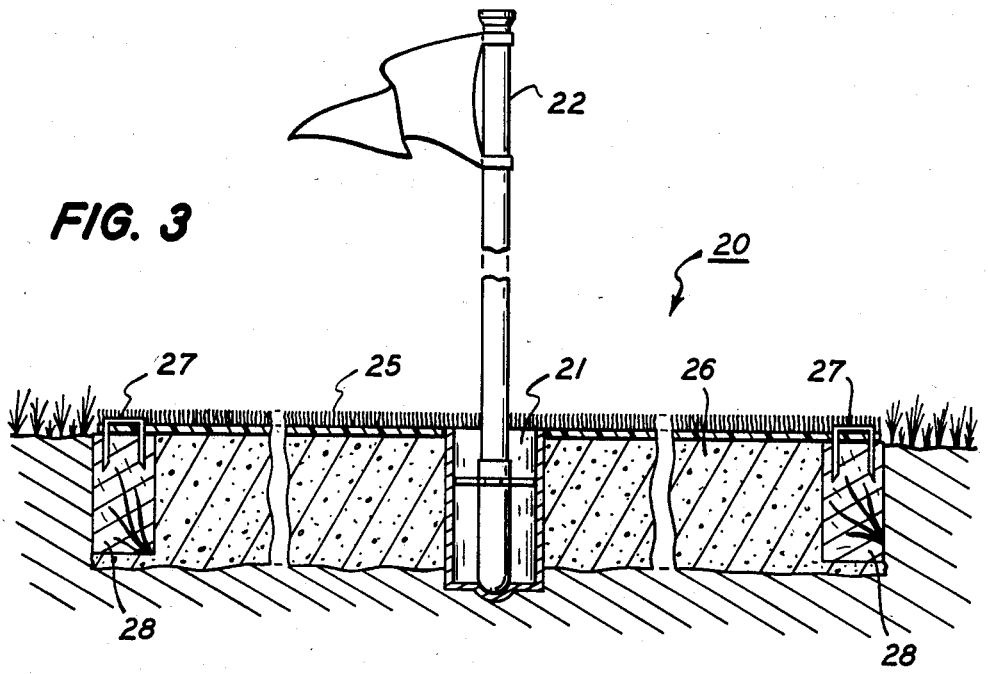
FIG. 3 is a fragmentary cross-sectional view of a green preferred for use in my short flight golf game.

The body 11 of ball 10 is formed of reticulated resinous foam veins 12 shown enlarged in FIG. 2. Foam veins 12 are preferably coated with a non-foamed resinous material such as polyvinyl chloride. A suitable material for foam body 11 is presently available from the Scott Foam Division of the Scott Paper Company and is called Scott Industrial Foam (SIF) PVC-coated (Scott Foam division, 1500 East Second Street, Chester, Pa., 19013).

Veins 12 are preferably spaced an average of about 8 to 15 veins per inch, producing a corresponding number of pores or voids 13 per inch. Voids 13 between reticulated veins 12 preferably form at least a 90% void volume within foam body 11.

Reticulated veins 12 are severed at the spherical exterior 14 of body 11. This leaves veins 12 and voids 13 in open communication with air surrounding ball 10 and occupying voids 13.

The large volume of voids 13 and small volume of reticulated veins 12 provides low resistance to air flow so that air moves through voids 13 as ball 10 flies through air. Air movement through body 11 within the boundary of the severed spherical exterior 14 produces sufficient aerodynamic drag to shorten the flight of ball 10 to the preferred maximum distance of about 60 to 70 feet.

The flight distance of ball 10 is affected by the weight of core 15 and the aerodynamic drag of the veins and voids between core 15 and ball surface 14. Making the core heavier lengthens the flight by adding to the ball's mass, and making the core larger lengthens the flight by reducing the thickness of the vein network and thus reducing the aerodynamic drag. Increasing the resistance of the vein network to air flow can also increase the flight length. Apparently a higher resistance to air flow causes less ambient air to penetrate the vein network of body 11 at the flight speeds of the ball, thus reducing aerodynamic drag and increasing flight distance.

Body 11 is preferably about $1\frac{3}{4}$ inches in diameter, which is only slightly larger than the diameter of a regulation golf ball so that it can be hit with regulation golf clubs. Central core 15 is preferably about $\frac{1}{2}$ to $\frac{3}{4}$ inches in diameter, leaving a substantial portion of body 11 exposed to air flow as the ball flies.

The exterior surface 14 of body 11 cannot be molded, because this would form an external skin. Severing veins 12 at exterior surface 14 ensures that veins 12 and voids 13 produce the aerodynamic drag required to hold the flight of the ball to a reasonably short distance.

Core 15 is also substantially lighter than a regulation golf ball and preferably weighs about b 10 grams. This is enough weight to give the golfer the familiar click sound and hitting feel when hitting ball 10.

Core 15 can be formed in place within body 11 by injecting a flowable material into the center of body 11. One suitable material is a liquid filler for steel sold under the designator LS-1 and the Duro brandname by the Loctite Corporation, 4450 Cranwood Court, Cleveland, Ohio, 44128. Steel filler is an adhesive that includes a resinous material that sets core 15 in place after injection into body 11.

Body 11 can also be slit inward from its severed exterior 14 to its center, and a preformed and preferably low-resilient weight such as a metal ball can be inserted through the slit to the center of body 11. The slit can be reclosed with adhesive. Body 11 can also be cut in half to receive a weighted core 15 around which the body halves are rejoined with adhesive.

Increasing the weight or size of core 15 tends to make ball 10 fly farther. This could be done deliberately for larger than usual short flight courses. Reducing the weight of core 15 below 10 grams impairs its ability to simulate regulation golf ball hitting. To preserve the aerodynamic drag of body 11, I prefer making core 15 as small as practical by using materials with high specific gravities.

The reticulated vein network of body 11 resiliently collapses as ball 10 is hit with a club or hits an object. This, combined with the low weight of core 15, makes ball 10 safe around houses, people, and animals.

For a good shot, a golf club head must sweep through the space occupied by core 15, thus making the effective hittable size of ball 10 substantially smaller than a regulation golf ball. A golf club head sweeping through foam body 11 and only grazing core 15 produces very poor shots compared to the effect of the same club head path encountering a regulation golf ball. This adds to the challenge and interest of short flight golf.

Figure 4:
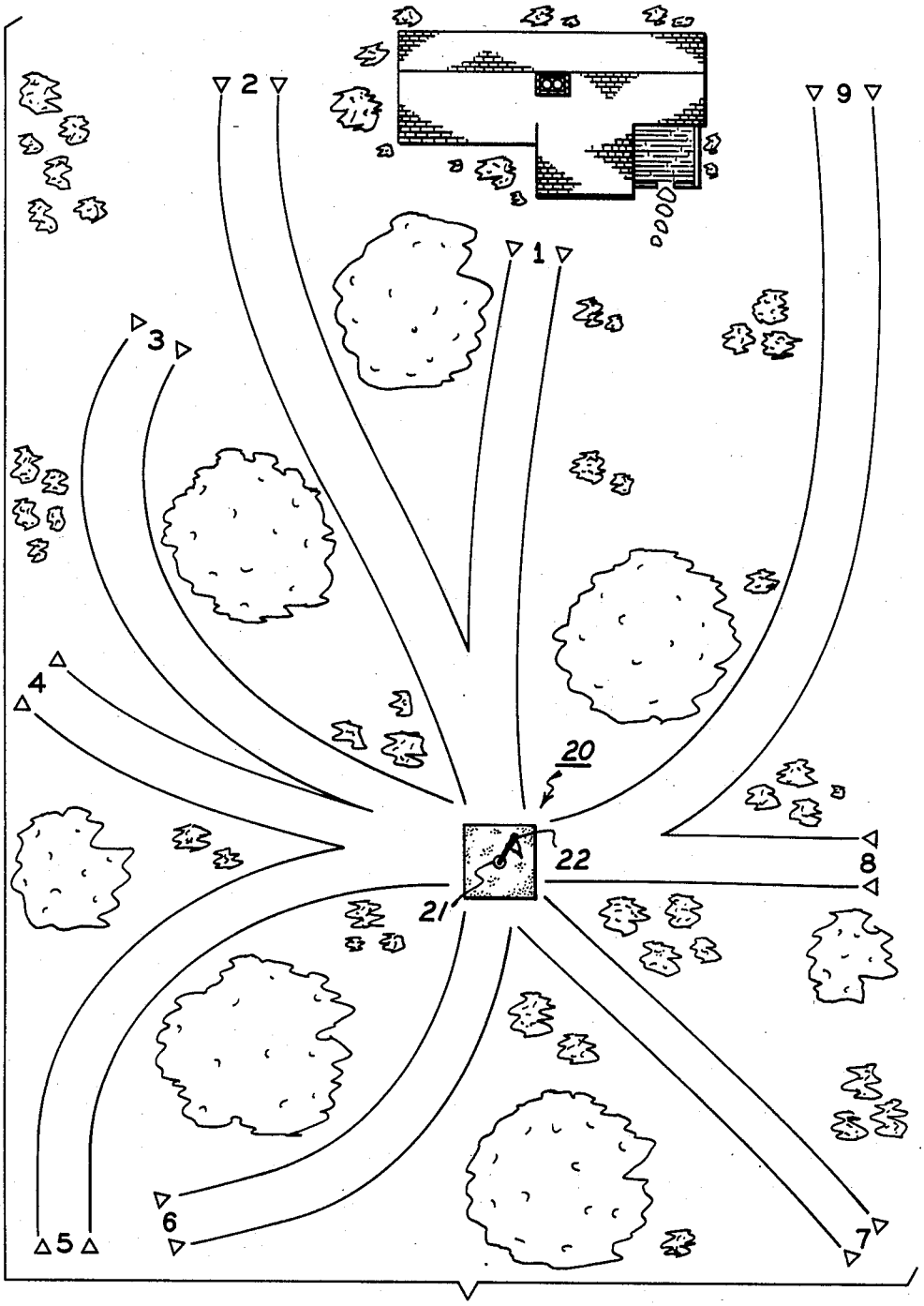
FIG. 4 is a partially schematic view showing how my short flight golf course can be laid out in a backyard.

A short flight golf course arranged in a constricted space preferably converges on a single putting green 20 as shown in FIG. 4. Green 20 has a conventional cup 21 and pin or flag 22; but instead of actual grass, green 20 is preferably surfaced with resin carpeting 25.

I have found that resin carpeting 25 can be laid on a bed of crushed stones or cold asphalt material 26 to form a durable green 20. I prefer asphalt material 26, and I use stables 27 that fasten the perimeter of resin carpet 25 securely to a frame 28 within which asphalt 26 is laid.

A short flight golf course is not limited to a single green 20, but preferably several fairways lead from several tees to any one green 20 so as to conserve space. Layouts of fairways and tees for short flight golf courses offer infinite variety, as the example of FIG. 4 suggests.

The many objects found in yards around houses can be used as hazards or obstacles. These can include pools, children's play equipment, dog houses, and utility sheds. Bushes and trees can serve as boundaries for dogleg fairways. Tees can be arranged on elevated decks, docks, banks, or sunken rock gardens. If space permits, fairways can be long enough to form par 5 holes or short enough to reach the green in a single shot.

A short flight ball is played sequentially from tees to green; and once the short flight ball is driven to a lie on green 20, it is replaced with a regulation golf ball for putting. Local rules could also include a ring around green 20 within which a regulation ball is substituted for a short flight ball.

I claim:

1. A short flight golf ball comprising:

a. a spherical foam body approximately the size of a regulation golf ball for hitting with regulation golf clubs;

b. said foam body being formed of reticulated resinous veins;

c. a core weighing substantially less than a regulation golf ball;

d. said core being substantially smaller than a regulation golf ball;

e. said core being located in the center of said foam body;

f. said reticulated veins being severed at the spherical exterior of said foam body; and g. said reticulated veins in the region between said core and said severed exterior having a sufficient void volume so that air moves through voids between said veins as said ball flies through air, and air movement relative to said reticulated veins produces sufficient aerodynamic drag to make the flight of said ball substantially shorter than the flight of a regulation golf ball.

2. The short flight ball of claim 1 wherein said reticulated veins are spaced an average of about 8–15 per inch.

3. The short flight ball of claim 1 wherein said core is formed of flowable material injected into said foam body and set in place.

4. The short flight ball of claim 1 wherein said core weighs about 10 grams.

5. The short flight ball of claim 1 wherein said void volume is at least 90%.

6. The short flight ball of claim 1 wherein said reticulated foam veins are coated with a non-foamed resin.

7. The short flight ball of claim 6 wherein said reticulated veins are spaced an average of about 8–15 per inch.

8. The short flight ball of claim 7 wherein said core weighs about 10 grams.

9. The short flight ball of claim 8 wherein said core is formed of flowable material injected into said foam body and set in place.

10. The short flight ball of claim 9 wherein said void volume is at least 90%.

11. A short flight golf game comprising:

a. a green with a cup and a flag;

b. a plurality of fairways arranged to approach said green from different directions and distances;

c. a plurality of tee regions on opposite ends of said fairways from said green;

d. a short flight golf ball played sequentially from said tees to said green; and e. said short flight golf ball comprising:

(1) a spherical foam body approximately the size of a regulation golf ball for hitting with regulation golf clubs;

(2) said foam body being formed of reticulated resinous veins;

(3) a core weighing substantially less than a regulation golf ball;

(4) said core being substantially smaller than a regulation golf ball;

(5) said core being located in the center of said foam body;

(6) said reticulated veins being severed at the spherical exterior of said foam body; and (7) said reticulated veins in the region between said core and said severed exterior having a sufficient void volume so that air moves through voids between said veins as said ball flies through air, and air movement relative to said reticulated veins produces sufficient aerodynamic drag to make the flight of said ball substantially shorter than the flight of a regulation golf ball.

12. The game of claim 11 wherein said green is formed of resinous carpeting material.

13. The game of claim 12 including asphalt material arranged under said carpeting.

14. The game of claim 11 wherein said reticulated veins are spaced an average of about 8–15 per inch.

15. The game of claim 14 wherein said core is formed of flowable material injected into said foam body and set in place.

16. The game of claim 15 wherein said reticulated foam veins are coated with a non-foamed resin.

17. The game of claim 16 wherein said void volume is at least 90%.

* * * * *